US009140480B2

(12) United States Patent
Kuehl et al.

(10) Patent No.: US 9,140,480 B2
(45) Date of Patent: Sep. 22, 2015

(54) ACTIVE INSULATION HYBRID DUAL EVAPORATOR WITH ROTATING FAN

(71) Applicant: Whirlpool Corporation, Benton Harbor, MI (US)

(72) Inventors: Steven Kuehl, Stevensville, MI (US); Alberto Gomes, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 255 days.

(21) Appl. No.: 13/834,048

(22) Filed: Mar. 15, 2013

(65) Prior Publication Data

US 2014/0260345 A1 Sep. 18, 2014

(51) Int. Cl.
*F25D 11/02* (2006.01)
*F25D 17/06* (2006.01)

(52) U.S. Cl.
CPC ..... *F25D 11/02* (2013.01); *F25D 17/065* (2013.01); *F25D 2317/0663* (2013.01); *F25D 2317/0681* (2013.01); *F25D 2400/04* (2013.01); *F25D 2400/28* (2013.01); *F25D 2400/30* (2013.01); *F25D 2700/12* (2013.01)

(58) Field of Classification Search
CPC ..... F25D 17/065; F25D 11/02; F25D 2317/0663; F25D 2317/0681; F25D 2400/28; F25D 2400/30; F25D 2700/12; F25D 2400/04
USPC ..... 62/62, 419, 426, 414, 515
See application file for complete search history.

(56) References Cited

U.S. PATENT DOCUMENTS

| | | | | |
|---|---|---|---|---|
| 2,094,321 | A * | 9/1937 | Haid | 126/110 R |
| 5,778,973 | A * | 7/1998 | Shin | 165/122 |
| 6,185,951 | B1 * | 2/2001 | Lane et al. | 62/246 |
| 6,929,149 | B2 * | 8/2005 | Selfridge et al. | 221/150 R |
| 7,818,974 | B2 * | 10/2010 | Kim et al. | 62/262 |
| 2003/0140638 | A1 * | 7/2003 | Arshansky et al. | 62/155 |
| 2003/0234259 | A1 * | 12/2003 | Selfridge et al. | 221/150 R |
| 2004/0033138 | A1 * | 2/2004 | Jung et al. | 416/223 R |
| 2004/0244396 | A1 * | 12/2004 | Lane et al. | 62/246 |
| 2005/0263536 | A1 * | 12/2005 | Selfridge et al. | 221/123 |
| 2010/0037650 | A1 * | 2/2010 | Lee et al. | 62/498 |
| 2010/0043455 | A1 * | 2/2010 | Kuehl et al. | 62/56 |
| 2010/0100243 | A1 * | 4/2010 | Lee et al. | 700/275 |
| 2010/0126207 | A1 * | 5/2010 | Bae et al. | 62/419 |
| 2010/0205997 | A1 * | 8/2010 | Bae et al. | 62/419 |
| 2012/0031112 | A1 * | 2/2012 | Kulkarni et al. | 62/62 |
| 2012/0144856 | A1 * | 6/2012 | Sherlock | 62/419 |
| 2012/0272670 | A1 * | 11/2012 | Choi et al. | 62/89 |

* cited by examiner

*Primary Examiner* — Mohammad M Ali

(57) ABSTRACT

An appliance having a fresh food storage compartment and a freezer compartment. The appliance includes a forced air coil system disposed between the fresh food storage compartment and the freezer compartment and is configured to selectively provide cooling to one or both of the at least one fresh food storage compartment and the at least one freezer compartment. The forced air coil system includes an evaporator fan configured to provide cooling to the food storage compartment, the freezer compartment, or both.

19 Claims, 7 Drawing Sheets

ACTIVE INSULATION HYBRID DUAL EVAPORATOR WITH ROTATING FAN

FIELD OF THE INVENTION

The present invention generally relates to an appliance cooling system and a method for constructing therefore.

SUMMARY OF THE INVENTION

An aspect of the present invention is generally directed towards an appliance having an interior that includes a fresh food storage compartment and a freezer compartment separated by a mullion. The fresh food compartment has a direct cooling evaporator disposed in thermal communication with the fresh food storage compartment in order to provide cooling to the fresh food storage compartment. The freezer compartment includes a direct cooling evaporator disposed in thermal communication with the freezer compartment to provide cooling to the freezer compartment. The appliance further includes a forced air coil system disposed between the fresh food storage compartment and the freezer compartment. The forced air coil system is configured to selectively provide cooling to one or both of the fresh food storage compartment and the freezer compartment. The forced air coil system includes at least one turbo chilling evaporator and at least one moving evaporator fan which is operably and rotatably connected to the fresh food storage compartment and the freezer compartment.

Another aspect of the present invention is generally directed to an appliance cabinet having a food storage compartment, a freezer compartment, and a forced air coil system. The forced air coil system is in thermal communication and configured to provide cooling to the food storage compartment and the freezer compartment. Additionally, the forced air coil system is disposed within a cavity between the food storage compartment and the freezer compartment. The forced air coil system includes at least one turbo evaporator and at least one pivoting evaporator fan. The pivoting evaporator fan is operably and rotatably connected to be positioned in a first position which provides cooling to the food storage compartment and a second position which provides cooling to the freezer compartment.

Yet another aspect of the present invention is generally directed towards a method of providing cooling to a food storage compartment and a freezer compartment. An appliance cabinet includes a food storage compartment which receives cooling from the fresh food compartment evaporator and a freezer compartment which receives cooling from a freezer compartment evaporator and a forced air coil system disposed between the food storage compartment and the freezer compartment. Additionally, the forced air coil system is in air flow communication with both the food storage compartment and the freezer compartment. Moreover, the forced air coil system comprises a booster evaporator and an evaporator fan. Next, the evaporator fan is pivoted in a rotational motion to the first position in order to provide air flow to the fresh food storage compartment. Next the moisture is sublimated from the turbo evaporator and into the fresh food compartment in order to defrost the turbo evaporator. Next, the pivoting evaporator fan pivots in rotational motion to a second position which provides airflow to the freezer compartment. Finally, the evaporator fan can split its airflow between the at least one food storage compartment and the at least one freezer compartment.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessarily to scale, but relative special relationships are shown and the drawings may be to scale especially where indicated. As such, in the description or as would be apparent to those skilled in the art. Certain features of the invention may be exaggerated in scale or shown in schematic form in the interest of clarity and conciseness.

DETAILED DESCRIPTION

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

The present invention is generally directed toward appliance systems and methods for increasing the efficiency (coefficient of performance) of the appliance. The appliance systems may be bottom mount freezer systems, top mount freezer systems, side by side refrigerator and freezer system, or French door style bottom mount freezer systems that may or may not employ a third compartment, typically a drawer that may operate as a refrigerator drawer or a freezer drawer.

Figure 1:
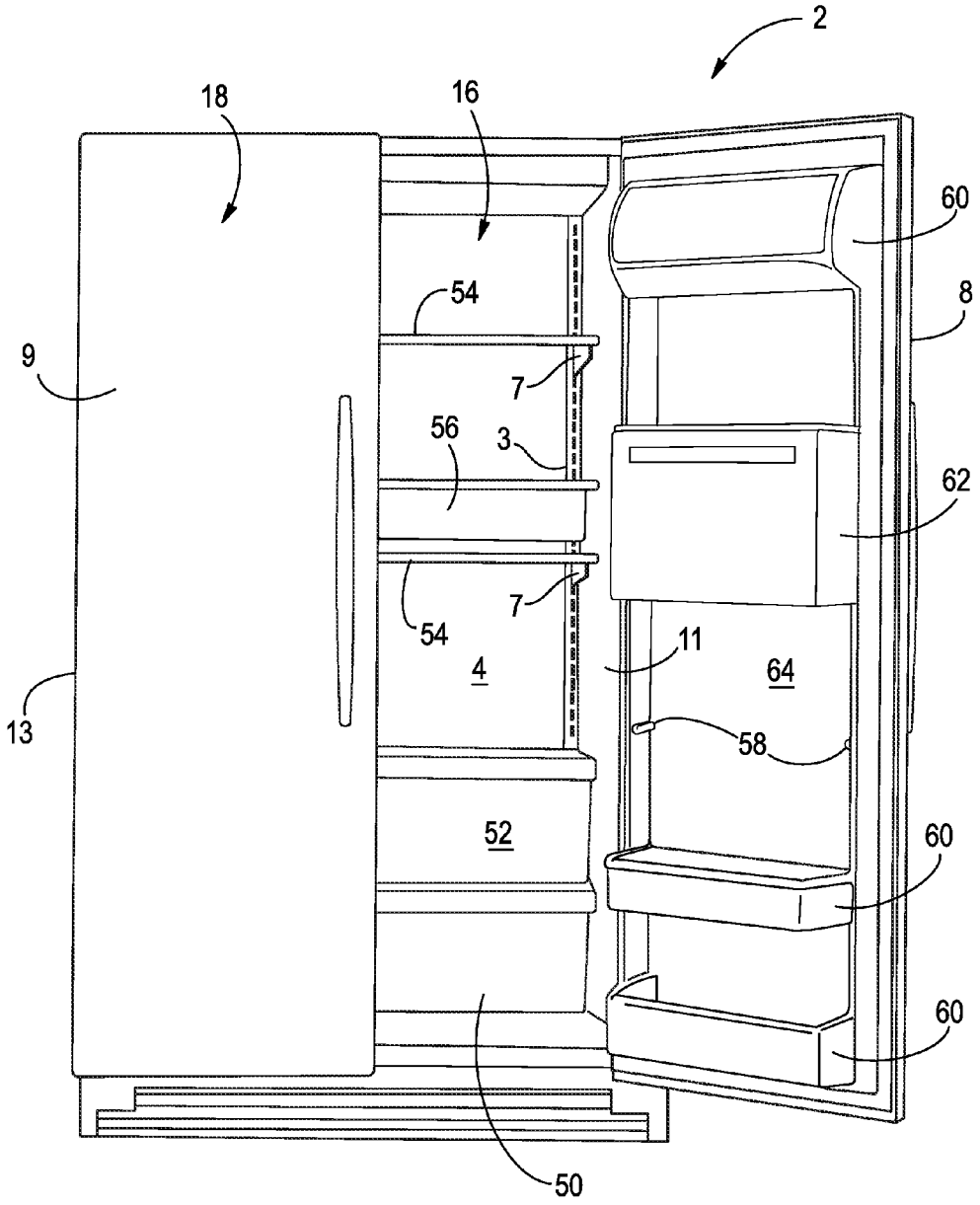
FIG. 1 is a perspective view of a side-by-side refrigerator freezer incorporating the multiple evaporator system.

The refrigerator 2 is adapted to receive and/or be capable of receiving a variety of shelves and modules at different positions defined by, in the embodiment shown in FIG. 1, a plurality of horizontally spaced vertical rails 3 extending from the rear wall 4 of the refrigerator and freezer cabinet sections or compartments 16, 18. In the embodiment shown, the supports are in the form of vertically extending rails 3 with vertically spaced slots for receiving mounting tabs on shelf supports 7 and similar tabs on modules, such as modules 50 (crisper), 52 (crisper), 54 (shelf unit), and 56 (drawer), for attaching the modules in cantilevered fashion to the cabinet sections 16, 18 at selected incrementally located positions. The inside edges of doors 8 and 9 also include vertically spaced shelf supports, such as 58, for positioning and engaging bins 60 and modules, such as 62, in the doors, in particular within the pocket of the door defined by the liner 64. The shelves, modules, bins, and the like, can be located at a variety of selected locations within the cabinet sections 16, 18 and doors 8, 9 to allow the consumer to select different locations for convenience of use.

Some of the modules in refrigerator 2, such as modules 50 and 62, may be powered modules or components and therefore require operating utilities. Thus, for example, module 50 may be a powered crisper or an instant thaw or chill module and may require utilities, such as cooled or heated fluids or electrical operating power and receive these utilities from the appliance. Other modules, such as module 62, may likewise require operational utilities while modules, such as a passive crisper module, would not. Door modules also, such as module 62, may, for example, include a water dispenser, vacuum bag sealer or other accessory conveniently accessible either from the outside of door 8 or from within the door and likewise may receive operating utilities from conduits, such as disclosed in application Ser. No. 12/469,915 filed May 21, 2009, entitled Refrigerator Module Mounting System; and Ser. No. 12/469,968 filed May 21, 2009, entitled Multiple Utility Ribbon Cable. The disclosures of these patent applications are incorporated herein by reference in their entirety. While not shown in the figures, the modules may also be used for quick cooling of beverages, quick freezing/chilling of other food stuffs or even making of ice, ice pieces (cubes), or frozen products.

The present invention includes the use of sequential dual evaporator systems that employ a switching mechanism. The switching mechanism allows the system to better match total thermal loads with the cooling capacities provided by the compressor. Generally speaking, the appliance gains efficiency by employing the switching mechanism, which allows selection of the evaporator circuit to be fed refrigerant with a liquid line valving system resulting in independent fresh food and freezer cooling cycles of several (>4) minutes duration or via a rapid suction port switching, typically on the order of a fraction of a second. The suction side switching mechanism can be switched at a fast pace, typically about 30 seconds or less or exactly 30 seconds or less, more typically about 0.5 seconds or less or exactly 0.5 seconds or less, and most typically about 10 milliseconds or less or exactly 10 milliseconds or less (or any time interval from about 30 seconds or less). As a result, the system rapidly switches between a freezer compartment operation mode and a refrigeration (fresh food) operation mode. The compressor 12 may be a variable capacity compressor, such as a linear compressor, in particular an oil-less linear compressor, which is an orientation flexible compressor (i.e., it operates in any orientation not just a standard upright position, but also a vertical position and an inverted position, for example). The compressor is typically a dual suction compressor or a single suction compressor with an external switching mechanism. When the compressor is a single suction compressor, it typically provides non-simultaneous dual suction from the coolant fluid conduits 20 from the refrigeration (fresh food) compartment and the freezer compartment.

As discussed above and shown generally in FIG. 2, the coolant system 10 utilized according to an aspect of the present invention typically includes a compressor 12 operably connected to at least one evaporator 14 where the compressor is typically the only compressor associated with the appliance for regulating the temperature of the first compartment 16 (typically the fresh food compartment) and the temperature of a second compartment 18 (typically the freezer compartment). The coolant system also typically employs: fluid conduits 20; at least one condenser 22, but typically a single condenser; a filter/dryer 24; and one or more expansion devices 26, such as a capillary tube or capillary tubes. The coolant system may also optionally employ one or more check valves 28 that prevent back flow of coolant fluid in the overall coolant system in the lower pressure fluid conduit. Check valves are typically employed when a multiple evaporator coolant system is employed operating in a non-simultaneous manner with different evaporating pressures. The check valve being incorporated into the lower pressure suction line.

Figure 2:
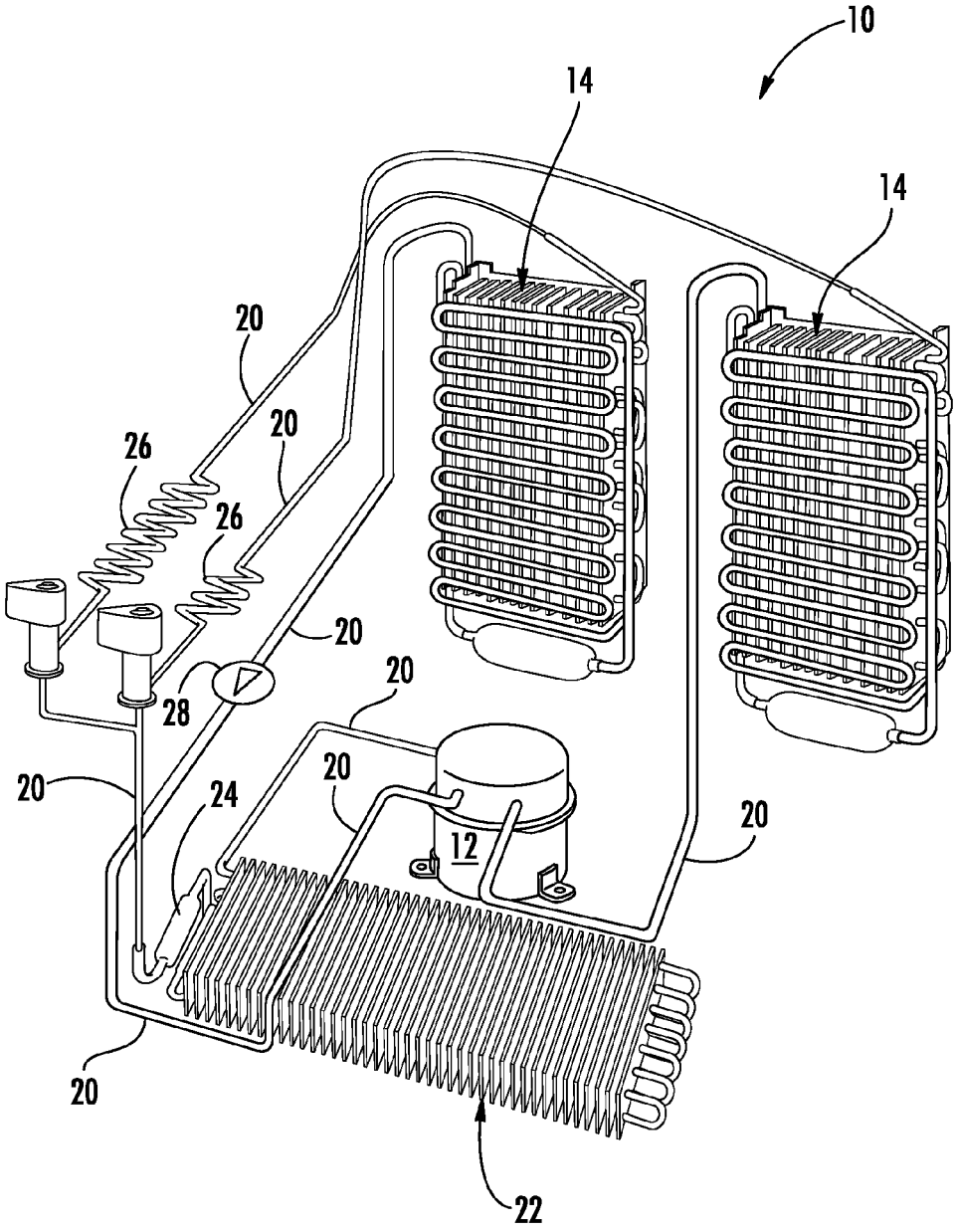
FIG. 2 is a schematic of a sequential dual evaporator system that may be utilized according to an aspect of the present invention.
Figure 3:
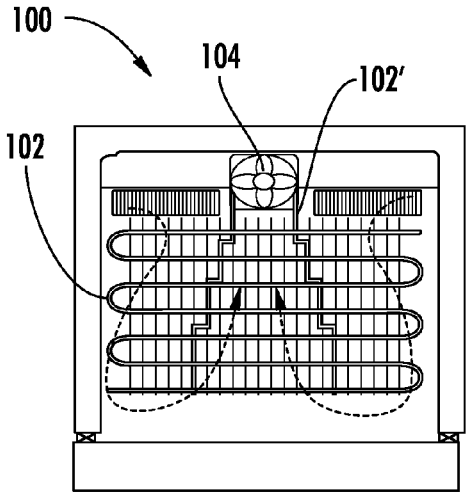
FIG. 3 is a top plan view of an evaporator fan and turbo evaporator disposed in the mullion.
Figure 4:
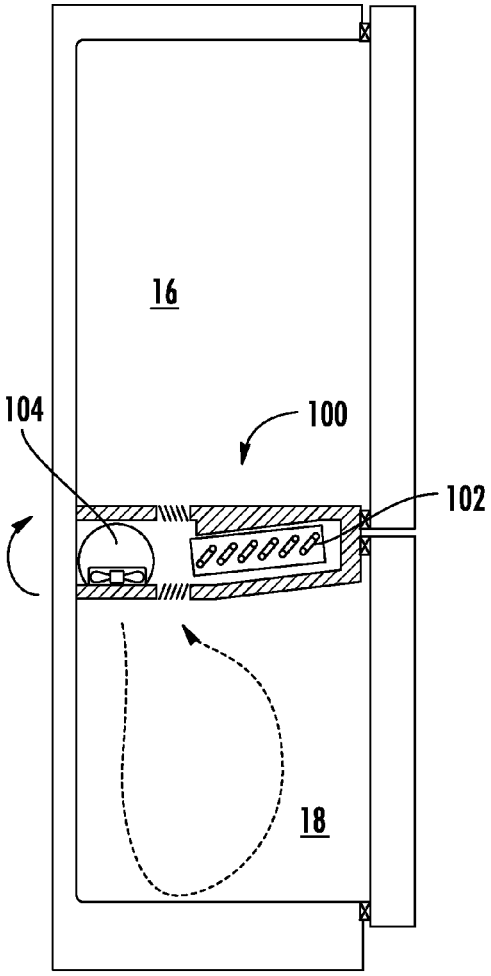
FIG. 4 is a side plan view of the evaporator fan and turbo evaporator disposed in the mullion.

As shown in FIG. 2, one aspect of the present invention utilizes a sequential, dual evaporator refrigeration system as the coolant system 10. The dual evaporator refrigeration system shown in FIG. 2 employs two evaporators 14 fed by two fluid conduits 20 engaged to two separate expansion devices 26.

As discussed above, the first compartment is typically the refrigeration or fresh food compartment. The second is typically the freezer compartment. While this is the typical configuration, the configuration could conceivably be two refrigeration compartments or two freezer compartments.

Figure 8:
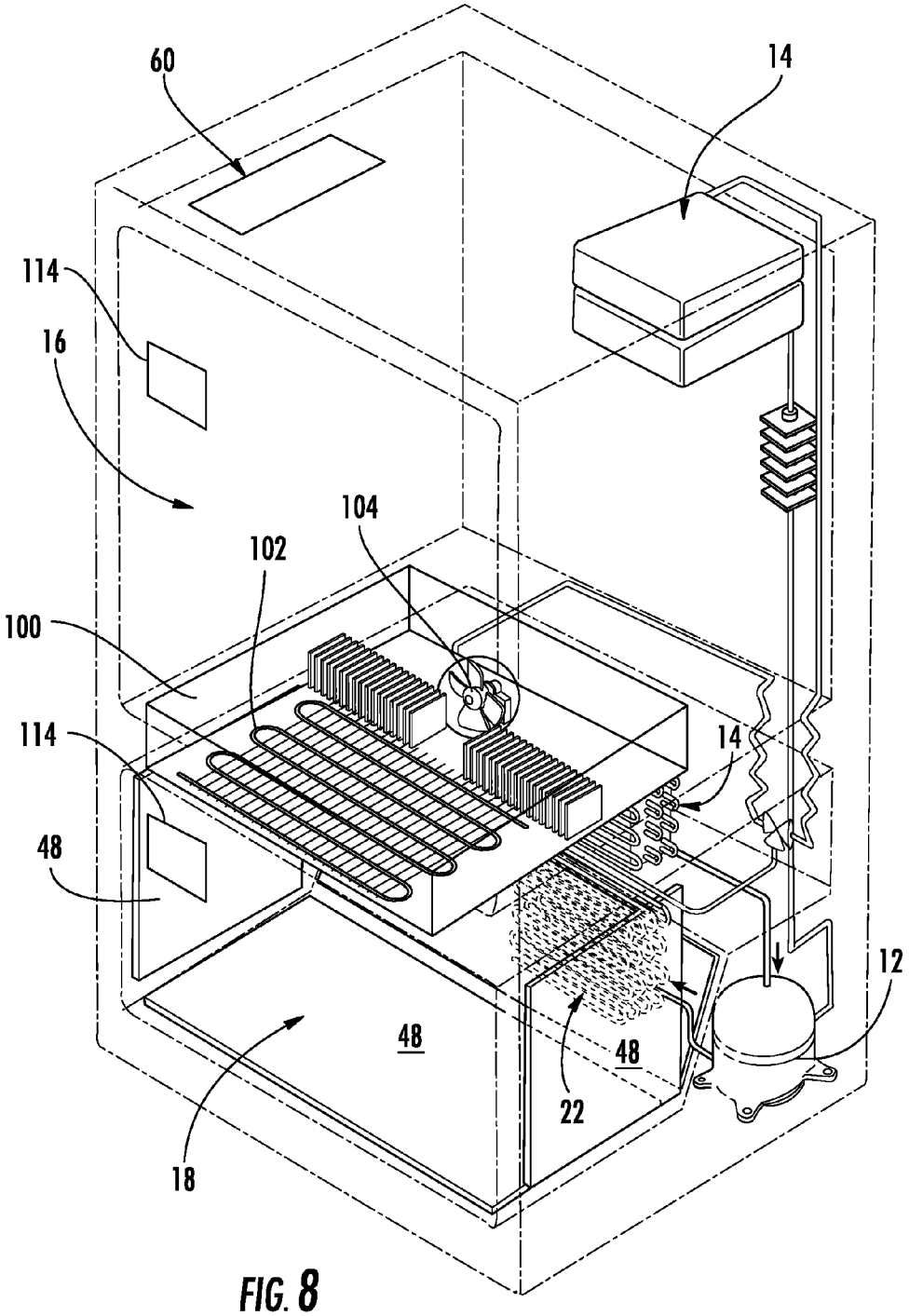
FIG. 8 is an interior schematic view of one embodiment of the present invention.
Figure 9:
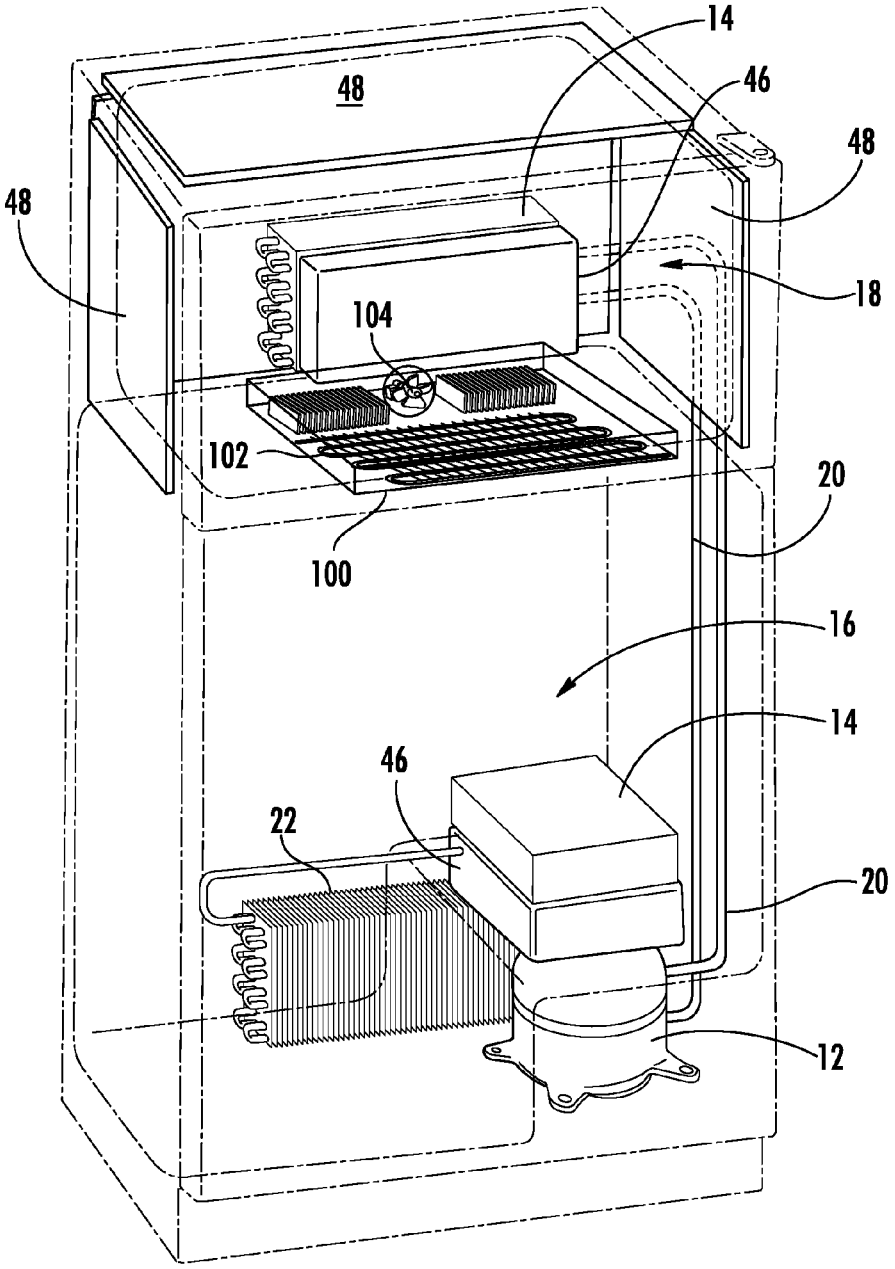
FIG. 9 is an interior schematic view of another embodiment of the present invention.
Figure 10:
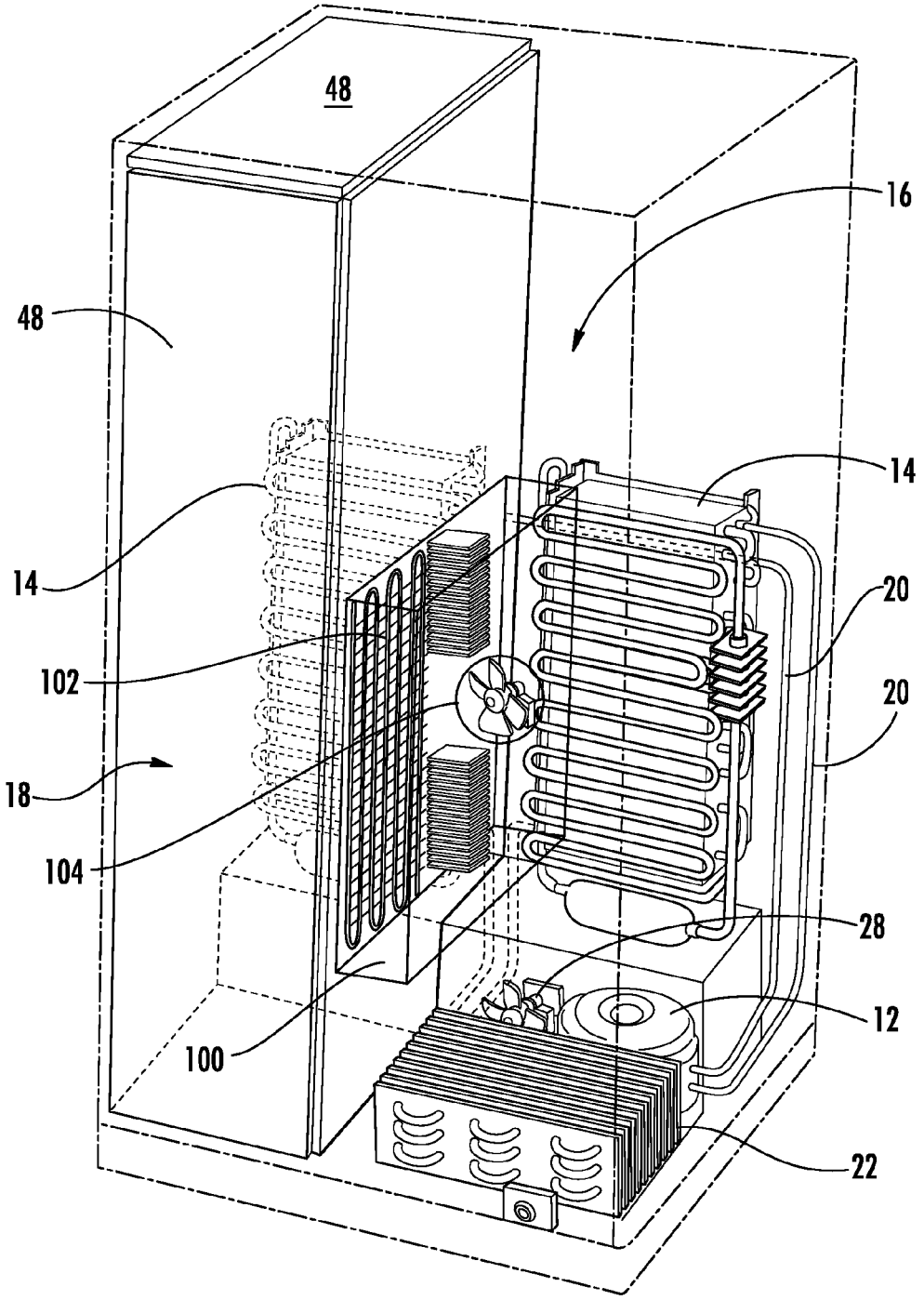
FIG. 10 is an interior schematic view of yet another embodiment of the present invention.

As shown in various figures, including FIGS. 8-10, the appliance may be any of the known configurations for a refrigeration appliance typically employed such as side by side, top mount freezer, bottom mount freezer or French door bottom mount freezer. Generally speaking, each of the embodiments employ at least two compartments, a first compartment 16, which is typically a fresh food compartment or a compartment operating at a higher operating temperature than a second compartment 18, which is typically a freezer compartment. Also, generally speaking each compartment has its own evaporator 14 associated with it. For example, while two evaporators are typically employed (one for the fresh food compartment and the other for the freezer compartment) a third may be used and associated with an optional third drawer. Fluid conduits 20 provide fluid flow from the compressor to at least one condenser 22, through a filter/dryer 24 (when utilized), through at least one expansion device 26 such as a capillary tube or tubes, and to at least one evaporator 14, more typically multiple evaporators. Ultimately, fluid is returned to the compressor 12. Fans 28, which are optional, are generally positioned proximate the evaporator(s) to facilitate cooling of the compartment/heat transfer. Similarly, fans 28 may be used in conjunction with the condenser 22 (see FIG. 10). Typically, fans improve heat transfer effectiveness, but are not necessary.

In the case of the top mount and bottom mount freezer, the mullion separating the compartments is typically a horizontal mullion. In the case of a side by side configuration, the mullion separating the two compartments is a vertical mullion.

The compressor 12 may be a standard reciprocating or rotary compressor, a variable capacity compressor, including but not limited to a linear compressor, or a multiple intake compressor system. When a standard reciprocating or rotary compressor with a single suction port is used the system further includes a compressor system 30 (not shown in figures). A compressor according to an aspect of the present invention may utilize a compressor system 40 that contains two coolant fluid intake streams such as one from the refrigerator compartment evaporator and one freezer compartment evaporator. When a linear compressor, which can be on oil less linear compressor, is utilized, the linear compressor has a variable capacity modulation, which is typically larger than a 3 to 1modulation capacity typical with a variable capacity reciprocating compressor. The modulation low end is limited by lubrication and modulation scheme.

Thermal storage material may also be used to further enhance efficiencies of the appliance. Thermal storage material 46 (FIG. 9), which can include phase changing material or high heat capacity material or high heat capacity material such as metal solids can be operably connected to the first compartment evaporator. The thermal storage material may be in thermal contact or engagement with the first compartment evaporator, in thermal contact or engagement with the fluid conduit(s) 20 operably connected to the first compartment evaporator, or in thermal contact or engagement with both. The use of the thermal storage material helps prevent relatively short relatively short "down" time of the compressor 12. Similarly, a thermal storage material can be associated with the second evaporator/compartment. Additionally, the second compartment may have vacuum insulation panels 48 insulating it to further improve the efficiency of the system by driving more of the thermal load to the first compartment.

Figure 7:
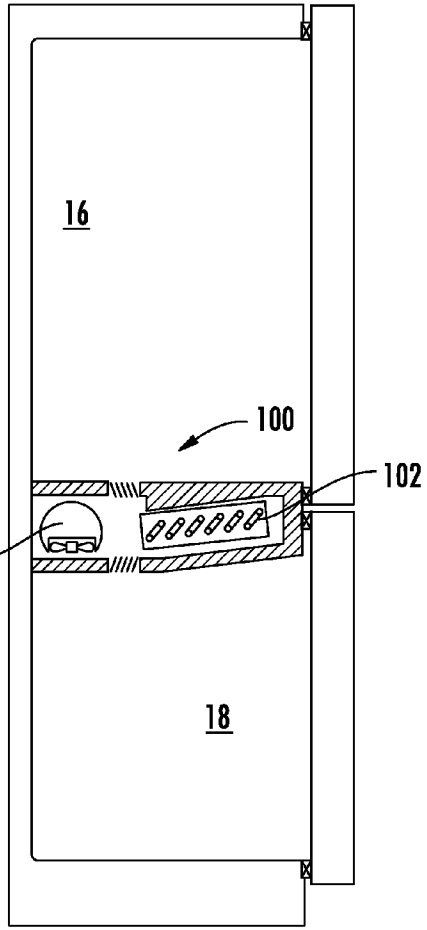
FIG. 7 is a side plan view of the pivoting evaporator fan of the present invention disposed to supply the freezer compartment.
Figure 6:
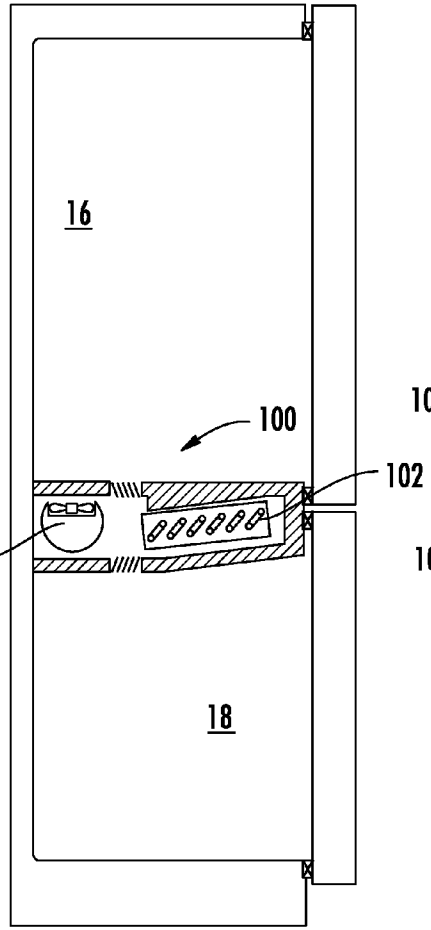
FIG. 6 is a side plan view of the pivoting evaporator fan of the present invention disposed to supply the fresh food compartment.
Figure 5:
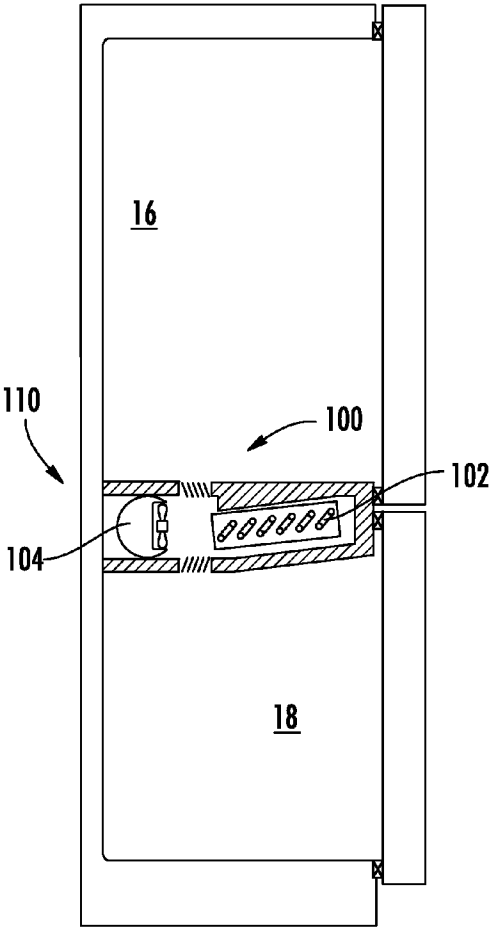
FIG. 5 is a side plan view of the pivoting evaporator fan of the present invention disposed to supply both fresh food and freezer compartments.

One aspect of the present invention, shown in FIGS. 3-7 includes a forced air coil system 100 which is disposed in the mullion between the food storage compartment 16 and the freezer compartment 18. The forced air coil system 100 is configured to provide cooling to one or both of the fresh food storage compartment 16 and the freezer compartment 18. Additionally, the forced air coil system 100 includes at least one turbo chilling evaporator 102, which typically does not have evaporator fins, and at least one moving evaporator fan 104 which is operably and rotatably connected to the fresh food storage compartment 16 and the freezer compartment 18. As shown in FIGS. 5-7, the evaporator fan 104 is configured to move between at least a first position 106 (FIG. 6), a second position 108 (FIG. 7), and a third position 110 (FIG. 5). The pivoting evaporator fan 104 generally rotates in rotational motion using a semi-circular carriage, typically driven by an actuator such as a synchronous motor with the ability to operate in a clockwise and a counter-clockwise rotation. When the pivoting evaporator fan 104 is in the first position 106, it is configured to provide cooling or fast recovery cooling to the fresh food storage compartment 16. When the evaporator fan 104 is in the second position 108, the forced air coil system 100 is configured to provide cooling to the freezer compartment 18. Moreover, when the evaporator fan 104 is in the third position 110, the forced air coil system 100 is configured to provide cooling to both the fresh food storage compartment 16 and the freezer compartment 18. Additionally, the fan carriage via linkages can drive sliding air doors (not shown) for covering the compartment air inlets and diffusers to forced air coil system 100, thus selectively isolating forced air coil system 100 from thermal convection communication with the respective fresh food or freezer compartments. An air flow separator 102' (FIG. 3) incorporated into the turbo chilling coil 102 can be employed to allow the respective compartment air return to be located adjacent the evaporator fan 104 discharge diffusers without allowing the return inlet air to short circuit to the fan within forced air coil system 100. Additionally this air flow separator 102' can be straight section or stari stepped as shown. If stair stepped, the separator serves to accelerate the air flow over the evaporator surface and thus enhances heat transfer between evaporator coil and air stream. The evaporator fan 104 is connected to a central unit 60 and temperature sensors 114 (shown in FIG. 8), typically employing a CPU which provides logic for driving operations of compressor, valves, fans, fan carriage positioning, and temperature sensing.

The forced air coil system 100 uses input from the sensors 114 and a user set point in order to determine when to deliver the turbo chilling to the fresh food compartment 16, the freezer compartment 18, or both. The forced air coil system 100 is configured to provide shock freezer capability dehumidification or fast recovery for the fresh food compartment 16 and the freezer compartment 18. Significantly, by having the forced air coil system 100 outside of the freezer compartment 18 and the fresh food storage compartment 16, the turbo evaporator coil 102 can be defrosted without heating up either the food storage compartment 16 or the freezer compartment 18.

The refrigerator may also include a variable capacity compressor 12, a condenser 22, at least two valves and cooling conduits 20 that are configured to operably deliver coolant to and from the condenser 22. Further, the appliance may include a direct cooling evaporator 14 in the fresh food compartment 16, a direct cooling evaporator 14 in the freezer compartment 18 and at least one turbo evaporator 102. Additionally, a common refrigerant coolant conduit section 20 is the only coolant outlet from the compressor 12. Moreover, the condenser 22 can be the only condenser 22 that supplies coolant to the fresh food compartment direct cooling evaporator 14, the freezer compartment direct cooling evaporator 14, and the turbo chilling evaporator 102. The coolant leaves each of the evaporators 14 and merges into a shared coolant flow either within the compressor 12 or after the coolant passes through the evaporators 14, but before entering the compressor 12. In this case, the compressor 12 is the only compressor 12 that supplies coolant to the condenser 22. The compressor 12 may also be at least a triple suction compressor with a first port suction receiving coolant from the fresh food compartment direct cooling evaporator 14, a second port suction receiving coolant from the freezer compartment direct cooling evaporator 14 and a third port suction receiving coolant from the turbo chilling evaporator 102. Further, the variable capacity compressor 12 can be a linear compressor.

FIGS. 8-10 show different refrigerator configurations each having the forced air coil system 100 of the present invention. The cooling systems may be incorporated into a variety of appliance configurations, including a bottom mount freezer system, a top mount freezer system, a side by side configuration, and a French door configuration that may or may not further include an optional third drawer that may function as either a freezer or a refrigerator (fresh food) compartment.

The forced air coil system 100 of the present invention helps maintain either the fresh food storage compartment, or the freezer compartment, or both at a steady temperature in order to optimize food preservation. Additionally, the forced air coil system 100 of the present invention is capable of providing shock freeze capability or ultra-fast recovery for better freezer storage life. Moreover, as discussed above, placing the forced air coil system 100 in the mullion of the appliance, allows the evaporator coil of the forced air coil system 100 to heat up without heating up the freezer compartment or the fresh food storage compartment of the appliance.

Those skilled in the art with recognize, or be able to ascertain using no more than routine experimentation, many equivalents to the specific embodiments of the invention described herein. Such equivalents are intended to be encompassed by the following claims.

What is claimed is:

1. An appliance comprising:

an appliance cabinet comprising an interior that includes at least one fresh food storage compartment and at least one freezer compartment separated by at least one mullion;

a fresh food compartment direct cooling evaporator disposed in thermal communication with the at least one fresh food storage compartment to provide cooling to the at least one fresh food storage compartment;

a freezer compartment direct cooling evaporator disposed in thermal communication with the at least one freezer compartment to provide cooling to the at least one freezer compartment; and a forced air coil system disposed between the at least one fresh food storage compartment and the at least one freezer compartment and configured to selectively provide cooling to one or both of the at least one fresh food storage compartment and the at least one freezer compartment and comprising:

at least one turbo chilling evaporator; and at least one moving evaporator fan operably and rotatably connected to the at least one fresh food storage compartment and the at least one freezer compartment, wherein the appliance further comprise appliance walls and the forced air coil system is at least partially disposed in at least one wall or the mullion and wherein the at least one turbo chilling evaporator is free of evaporator fins.

2. The appliance of claim 1, wherein the moving evaporator fan is a pivoting evaporator fan that provides air flow selectively from the turbo chilling evaporator to the at least one freezer compartment or the at least one fresh food storage compartment or splits the air flow into both the at least one freezer compartment and the at least one fresh food storage compartment by moving between a first position, a second position and a third position that are each different from one another, and wherein the fan is connected to a central unit and temperature sensors and uses input from sensors and a user set point to determine when to deliver turbo chilling to the at least one freezer compartment, or the at least one fresh food storage compartment or both.

3. The appliance of claim 1, wherein the forced air coil provides shock freeze capability and the forced air coil system is positioned within the mullion.

4. The appliance of claim 1, wherein the forced air coil provides fast recovery for the at least one food storage compartment and the at least one freezer compartment.

5. The appliance of claim 1 further comprising a variable capacity compressor, a condenser, at least two valves and coolant conduits configured to operably deliver coolant to and from the condenser, the fresh food compartment direct cooling evaporator, the freezer compartment direct cooling evaporator and the at least one turbo evaporator and wherein a common refrigerant coolant conduit section is the only coolant outlet from the compressor.

6. The appliance of claim 5, wherein the at least one pivoting evaporator fan rotates in rotational motion using a semicircular carriage and the variable capacity compressor is one of: a linear compressor or a reciprocating compressor.

7. The appliance of claim 5, wherein the condenser is the only condenser that supplies coolant to the fresh food compartment direct cooling evaporator, the freezer compartment direct cooling evaporator and the turbo chilling evaporator and the coolant leaves each of the evaporators and merges into a shared coolant flow either within the compressor or after the coolant passes through the evaporators but before entering the compressor and wherein the compressor is the only compressor that supplies coolant to the condenser.

8. The appliance of claim 7, wherein the compressor is at least a triple suction compressor with a first suction port receiving coolant from the fresh food compartment direct cooling evaporator, a second suction port receiving coolant from the freezer compartment direct cooling evaporator, and a third suction port receiving coolant from the turbo chilling evaporator.

9. An appliance comprising:

an appliance cabinet comprising:

at least one food storage compartment;

at least one freezer compartment; and a forced air coil system in thermal communication and configured to provide cooling to the at least one food storage compartment and the at least one freezer compartment disposed within a cavity between the at least one food storage compartment and the at least one freezer compartment wherein the forced air coil system comprises:

at least one turbo evaporator; and at least one pivoting evaporator fan operably and rotatably connected to be positioned to a first position to provide cooling to the at least one food storage compartment and rotatably connected to be positioned in a second position to provide cooling to the at least one freezer compartment;

wherein the appliance further comprises appliance walls and the forced air coil system is at least partially disposed in at least one wall or a mullion and wherein the at least one turbo chilling evaporator is free of evaporator fins.

10. The appliance of claim 9, wherein the appliance cabinet further comprises:

at least one direct cooling evaporator disposed in the at least one food storage compartment; and at least one direct cooling evaporator disposed in the at least one freezer compartment; and wherein the at least one food storage compartment is at least one fresh food storage compartment.

11. The appliance of claim 9, wherein the pivoting evaporator fan is engaged to a rotation wheel and provides air flow to the at least one freezer compartment or the at least one food storage compartment or splits the air flow into both the at least one freezer compartment and the at least one food storage compartment.

12. The appliance of claim 9, wherein the appliance further comprises appliance walls and the forced air coil system is at least partially disposed in at least one wall or the mullion.

13. The appliance of claim 9, wherein the appliance further comprises a variable capacity compressor and wherein the at least one pivoting evaporator fan rotates in rotational motion using a semi-circular carriage and the variable capacity compressor is a linear compressor.

14. The appliance of claim 7, wherein the forced air coil system provides pull down cooling capacity for the at least one food storage compartment and the at least one freezer compartment and wherein the forced air coil system further comprises a variable capacity compressor, a condenser, at least two valves and coolant conduits configured to operably deliver coolant to and from the condenser, the fresh food compartment direct cooling evaporator, the freezer compartment direct cooling evaporator and the at least one turbo evaporator and wherein a common refrigerant coolant conduit section is the only coolant outlet from the compressor.

15. The appliance of claim 14, wherein the condenser is the only condenser that supplies coolant to the fresh food compartment direct cooling evaporator, the freezer compartment direct cooling evaporator and the turbo chilling evaporator and the coolant leaves each of the evaporators and merges into a shared coolant flow either within the compressor or after the coolant passes through the evaporators but before entering the compressor and wherein the compressor is the only compressor that supplies coolant to the condenser.

16. The appliance of claim 15, wherein the compressor is at least a triple suction compressor with a first suction port receiving coolant from the fresh food compartment direct cooling evaporator, a second suction port receiving coolant from the freezer compartment direct cooling evaporator, and a third suction port receiving coolant from the turbo chilling evaporator.

17. A method of providing cooling to a fresh food storage compartment and a freezer storage compartment within an appliance comprising the steps of:

providing an appliance cabinet comprising:

at least one fresh food storage compartment that receives cooling from a fresh food compartment evaporator;

at least one freezer compartment that receives cooling from a freezer compartment evaporator; and a forced air coil system disposed between and in airflow communication with both the at least one food storage compartment and the at least one freezer compartment and wherein the forced air coil system comprises:

a booster evaporator; and an evaporator fan;

pivoting the evaporator fan in rotational motion to a first position to provide air flow to the at least one fresh food storage compartment;

sublimating moisture from the booster evaporator and into the at least one fresh food compartment thereby defrosting the booster evaporator and hydrating air within the fresh food compartment;

pivoting the evaporator fan in rotational motion to a second position to provide air flow to the at least one freezer compartment; and pivoting the evaporator fan to split the air flow between the at least one food storage compartment and the at least one freezer compartment;

wherein the appliance further comprises appliance walls and the forced air coil system is at least partially disposed in at least one wall or a mullion and wherein the at least one booster chilling evaporator is free of evaporator fins.

18. The method of claim 15, wherein the appliance cabinet further comprises at least one fresh food compartment evaporator disposed in the at least one food storage compartment and at least one freezer compartment evaporator disposed in the at least one freezer compartment and wherein the forced air coil system is disposed in the mullion between the at least one food storage compartment and the at least one freezer compartment.

19. The method of claim 18 further comprising the steps of:

cooling the fresh food compartment using the fresh food compartment evaporator;

cooling the freezer compartment using the freezer compartment evaporator; and providing coolant primarily to the fresh food compartment when the evaporator fan is in a first position, primarily to the freezer compartment when the evaporator fan is in a second position and at least substantially evenly to both the fresh food compartment and the freezer compartment when the evaporator fan is in a third position and wherein the fresh food compartment evaporator and freezer compartment evaporator are free of a defrost heater.

* * * * *